US007971295B2

(12) United States Patent
Dippl et al.

(10) Patent No.: US 7,971,295 B2
(45) Date of Patent: Jul. 5, 2011

(54) PROTECTION FOR A LIFTING UNIT

(75) Inventors: Thomas Dippl, Pressath (DE); Klaus Hruschka, Erbendorf (DE); Mario Ring, Kemnath (DE); Josef Rupprecht, Erbendorf (DE)

(73) Assignee: Siemens Aktiengesellschaft, Munich (DE)

( * ) Notice: Subject to any disclaimer, the term of this patent is extended or adjusted under 35 U.S.C. 154(b) by 100 days.

(21) Appl. No.: 11/887,874

(22) PCT Filed: Mar. 31, 2006

(86) PCT No.: PCT/EP2006/061236

§ 371 (c)(1),
(2), (4) Date: Oct. 2, 2007

(87) PCT Pub. No.: WO2006/106083

PCT Pub. Date: Oct. 12, 2006

(65) Prior Publication Data

US 2009/0038073 A1 Feb. 12, 2009

(30) Foreign Application Priority Data

Apr. 6, 2005 (DE) ..... 10 2005 015 795

(51) Int. Cl.
*A47B 7/00* (2006.01)

(52) U.S. Cl. ..... 5/611; 5/600; 5/81.1 R

(58) Field of Classification Search ..... 5/611, 81.1, 5/600

See application file for complete search history.

(56) References Cited

U.S. PATENT DOCUMENTS

| | | | | |
|---|---|---|---|---|
| 4,671,728 | A * | 6/1987 | Clark et al. | 414/401 |
| 4,875,555 | A | 10/1989 | Johansson et al. | |
| 5,220,698 | A * | 6/1993 | Hannant | 5/611 |
| 5,613,255 | A * | 3/1997 | Bish et al. | 5/611 |
| 7,472,437 | B2 * | 1/2009 | Riley et al. | 5/600 |
| 2004/0094077 | A1 | 5/2004 | Stone | |
| 2005/0273932 | A1 * | 12/2005 | Horlin | 5/611 |
| 2006/0026762 | A1 * | 2/2006 | Hornbach et al. | 5/611 |

FOREIGN PATENT DOCUMENTS

| | | |
|---|---|---|
| EP | 0 198 946 A2 | 10/1986 |
| EP | 0 316 074 A2 | 5/1989 |
| EP | 0 555 198 A1 | 8/1993 |
| FR | 2 770 396 | 5/1999 |
| JP | 9-192175 | 7/1997 |
| WO | WO 01/49234 A1 | 7/2001 |
| WO | WO 03/088885 | 10/2003 |

OTHER PUBLICATIONS

Chinese Office Action dated Dec. 24, 2009 with English translation.

* cited by examiner

*Primary Examiner* — Robert G Santos
*Assistant Examiner* — Brittany M Wilson
(74) *Attorney, Agent, or Firm* — Lempia Summerfield Katz LLC

(57) ABSTRACT

The present embodiments relate to a lifting unit for a patient support. The lifting unit includes a base plate, a motor drive, a lifting drive driven by the motor drive and received in the base plate. The lifting drive is adapted to carry out a lifting movement and a movement in the opposite direction. A triggering element is activated when the pressure exerted by the lifting drive on the base plate falls below a defined minimum value. The movement of the lifting drive is stopped in response to the activation of the triggering element. If the patient support collides with an obstacle during lifting, the pressure exerted by the lifting drive on the base plate is reduced. The reduced pressure is detected by the triggering element and the movement of the patient support is stopped.

13 Claims, 4 Drawing Sheets

PROTECTION FOR A LIFTING UNIT

The present patent document is a §371 nationalization of PCT Application Serial Number PCT/EP2006/061236, filed Mar. 31, 2006, designating the United States, which is hereby incorporated by reference. This patent document also claims the benefit of DE 10 2005 015 795.5, filed Apr. 6, 2005, which is also hereby incorporated by reference.

BACKGROUND

The present embodiments relate to a lifting unit with protection, a patient support device including a lifting unit with protection, and a diagnosis or treatment device including a patient support device.

In medical diagnostics and treatment, equipment is used in which a patient is examined or treated using radiation, electromagnetic-waves, or sound-waves. In these cases, x-rays, electron or particle beams, ultrasound waves or magnetic fields are used. The equipment may include relatively heavy radiation and power sources and include corresponding detectors. The devices can be positioned by correspondingly huge mechanical structures installed in the room, and in most cases it is not possible to achieve completely free three-dimensional positioning.

Depending on the type of examination or treatment to be carried out, equipment for diagnosis and/or therapy or the power source can be moved into a certain spatial orientation and position with respect to the patient who is to be examined. The adjustment of the spatial configuration required is supported by positioning equipment installed in the room. Because the positionability is generally always restricted, not every possible spatial configuration of the patient and equipment can be achieved, however. Depending on the type of examination or treatment, a certain positioning of the patient may require, for example, back or side position, head-down, or standing, or other position. A patient support device may be used to position the patient with respect to the equipment.

Simultaneous positionability of the equipment and the patient increases the number of possible spatial configurations.

Positioning a patient using a patient support device consists of a one- or two-dimensional shifting into a geodetically horizontal plane. For positioning a patient, patient support device tables include a table top as a patient support with a floating mount. The floating mount may (or may not) include linear guidance, resulting in a one-dimensional or two-dimensional adjustability of the patient support. The height of the patient support can be adjusted. A lifting device oriented in a geodetically vertical position can adjust the height of the patient support 12. The lifting device lifts or lowers the patient support 12 generally from below. The lifting device may include a hydraulic, pneumatic or electric-motor drive and have a parallelogram or spindle drive mechanism. The patient support 12 is capable of being tipped or tilted. By combining all the adjustment options, maximum free positionability of the patient support 12 and the patient can be achieved.

In medical practice, apart from positionability, it is of particular importance that a patient is as unrestricted as possible and freely accessible. In the context of the treatment or examination, medical or technical professionals have to be able to approach the patient at any time. Therefore, a patient support device may include a stand (foot part) that is as narrow as possible and takes up little space to support the patient support.

A lifting unit that is arranged in the stand may be used for the height adjustment of the patient support 12. A scissor or double-scissor mechanism driven by a spindle drive may be provided in the stand as a lifting unit. The scissor or double-scissor mechanism may be connected by a solid bearing to a base plate of the patient support device. The spindle of the spindle drive forms a structural unit with a drive motor. The structural unit connects in a fixed manner to the base plate. The above design can be configured to be as narrow as possible so that patients are easily accessible.

A narrow stand has the advantage that the patient support that rests thereon projects beyond the extent of the stand. Below the projecting areas of the patient support, a free space appears which becomes bigger when the patient support is lifted and smaller when it is lowered. When it is lowered, the patient support can collide with objects or people occupying the free space. This collision endangers the equipment or the people occupying this space. When the patient support is raised, considerable tensile forces are exerted on the lifting unit that is connected to the base plate. These tensile forces can in the worst scenario lead to damage to the lifting unit.

WO 01/49234 discloses a patient support device that includes a motorized lifting drive. The patient support device includes IR barriers, which block or release a motorized movement. An IR sensor detects an impending collision of the patient support device with people or objects so that a motorized movement can be blocked with sufficient time.

US 2004/0094077 discloses a patient support device that includes a motorized lifting drive. In order to be able to stop a motorized downward movement of the patient support device in sufficient time, the patient support device has buttons on the base, the actuation of which stops the drive for the downward movement.

SUMMARY

The present embodiments may obviate one or more of the drawbacks or limitations inherent in the related art. For example, in one embodiment, a lifting unit protects against people and equipment being endangered when the lifting unit is shortened. In another embodiment, a patient support device includes a patient support for equipment for diagnosis and/or therapy and equipment for diagnosis and/or therapy including a patient support device that includes equipment, which guarantees protection against people and equipment being endangered when the lifting unit is lowered.

In one embodiment, a lifting unit for equipment for diagnosis and/or therapy, includes a base plate, a motorized drive, a lifting drive that can be driven by the drive and which is mounted in the base plate, and which can carry out a lifting movement and a movement in the opposite direction. A triggering device is provided. The triggering device is activated when the force exerted by the lifting drive on the base plate falls below a certain minimum value, the stopping of the movement being triggered in response to the triggering device being activated.

If the lifting drive collides with an obstacle when the patient support device and/or item of equipment for diagnosis and/or therapy is shortened or lowered, this obviously leads to the force exerted thereby on the base plate being reduced. Thus, the stopping of movement triggered by a reduction in the force exerted protects the person or device about to be collided with, since the collision is prevented by stopping the movement. The maximum collision force depends on the minimum value for the force exerted to activate the triggering device, combined with the total weight borne by the lifting drive. The maximum collision force is obtained by subtracting the total weight from the minimum value.

In one embodiment, a patient support device includes the aforementioned lifting unit and also equipment for diagnosis and/or therapy that includes a patient support device with the lifting unit described in the aforementioned.

DETAILED DESCRIPTION

Figure 1:
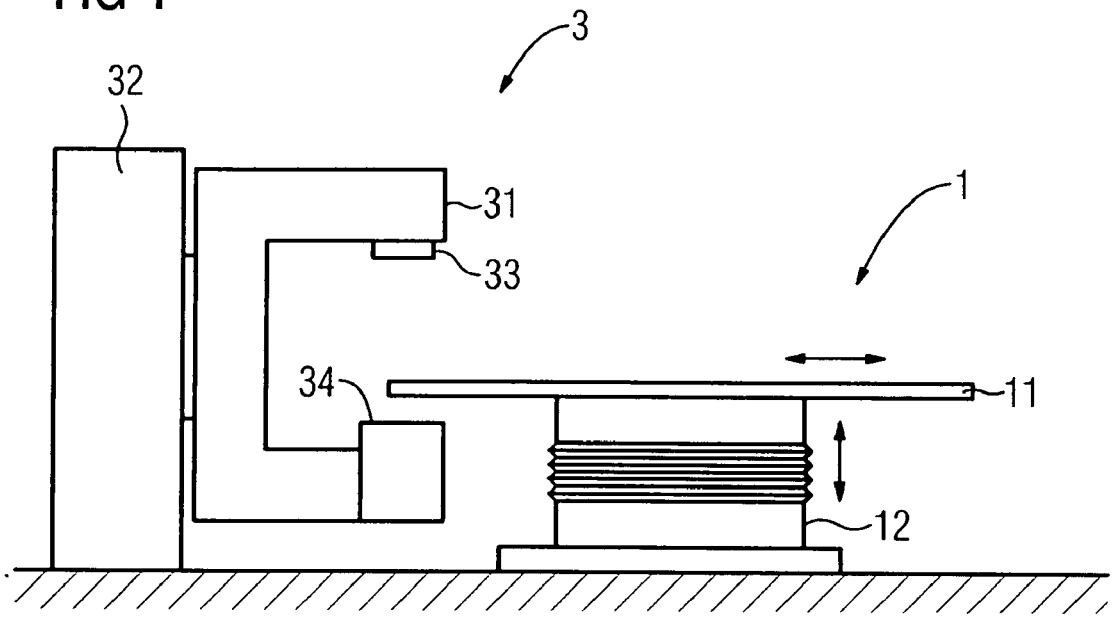
FIG. 1 illustrates equipment for diagnosis and/or therapy including a patient support device.

FIG. 1 illustrates equipment for diagnosis and/or therapy (DT device) 3 that includes a patient support device 1. The DT device 3 includes a C-arm 31, which supports an x-ray source 33 and an x-ray detector 34. The C-arm 31 can be used, for example, to generate x-ray images of low energy x-ray radiation, or for therapeutic irradiation of higher energy x-ray radiation. The C-arm 31 is housed in a C-arm stand 32. The C-arm stand 32 can be a free-standing structure installed in the room or a structure that is fitted into a wall or ceiling of the room. The C-arm 31 can position the x-ray source 33 and of the x-ray detector 34 such that a patient positioned with the aid of the patient support device 1 can be detected with the x-ray beam.

The patient support device 1 includes a patient support (couch) 11 on which a patient can lie. The patient support 11 can be moved in a horizontal direction, which is intended to be indicated by a horizontal two-headed arrow. The patient support 11 is mounted onto a stand (foot) 12 with a floating mounting. The height of the patient support 11 can be adjusted. The stand 12 includes a lifting device. The height adjustment is indicated by a vertical two-headed arrow.

Figure 2:
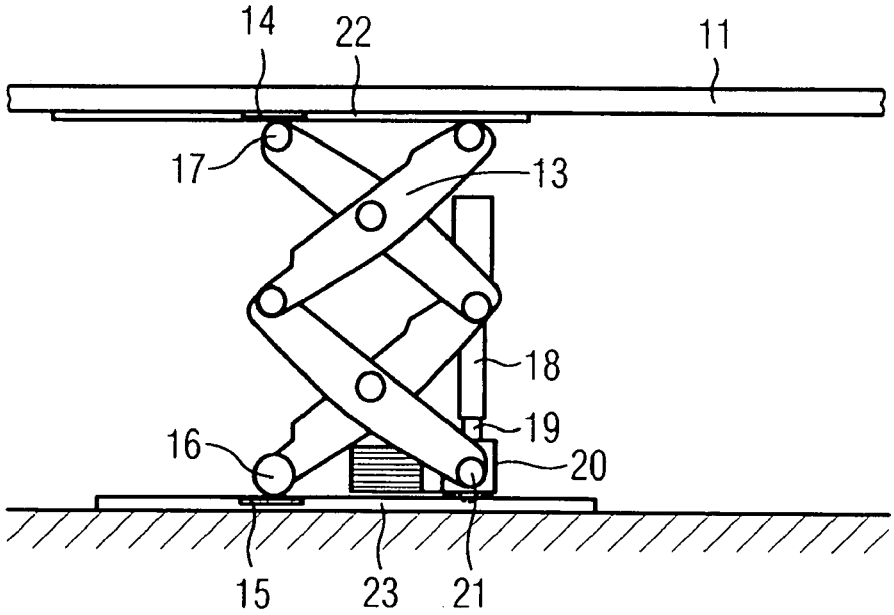
FIG. 2 illustrates a scissor structure and spindle drive of a patient support device.

FIG. 2 shows a lifting device of the patient support device 1. The lifting device includes a base plate 23 that is arranged in or integrated in the stand 12. A double-scissor mechanism 13, such as a structure consisting of two individual scissor mechanisms arranged one on top of the other, is mounted on the base plate 23. The double-scissor mechanism 13 is vertically oriented. The double-scissor mechanism 13 is shortened or lengthened in a vertical direction when actuated. The shortening or lengthening of the double-scissor mechanism 13 provides height adjustment of the lifting plate 22 that is mounted thereon. The lifting plate 22 is connected to the patient support 11, such that the double-scissor mechanism 13 provides height adjustment of the patient support 11 and a patient lying on the patient support 11.

The double-scissor mechanism 13 is mounted in a solid bearing 21 on the base plate 23. On the opposite side of the solid bearing 21, the double-scissor mechanism 13 is mounted in the base plate with a moveable bearing 16, which includes, for example, a sliding bearing 15. The combination of the solid bearing 21 with the moveable bearing 16 makes it possible to actuate the double-scissor mechanism 13. In order to be moveable against the lifting plate 22, the lifting plate 22 is mounted on the double-scissor mechanism 13 by a moveable bearing 17, which includes, for example, a sliding bearing 14 on the lifting plate 22. Above the solid bearing 21, the double-scissor mechanism 13 can be connected to the lifting plate 22 by a further solid bearing which is not shown in further detail in the FIG.

The actuation of the double-scissor mechanism 13 is achieved by a spindle drive. The spindle drive includes a spindle nut 18 connected to the double scissor mechanism 13 and also a spindle 19. By rotating the spindle 19 or the spindle nut 18, the height of the spindle nut 18 is adjusted and the length of the double-scissor mechanism 13 is adjusted. A drive 20 rotates the spindle 19 or the spindle nut 18. The drive 20 is connected to the spindle 19 in such a way that it is able to rotate the spindle 19. The drive 20 may be an electric motor, but it could also be actuated hydraulically, pneumatically or manually or be foot-operated.

Figure 3:
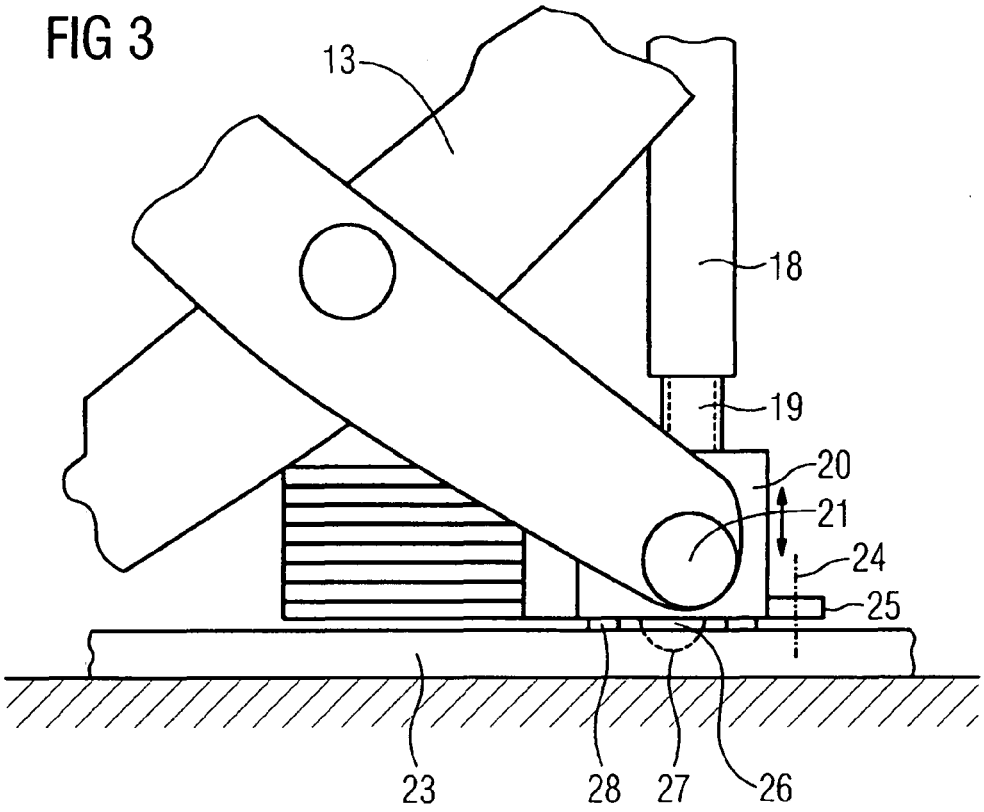
FIG. 3 illustrates a ball and socket bearing of the spindle drive.

In one embodiment, as shown in FIG. 3, the spindle drive includes a ball joint. FIG. 3 illustrates the double-scissor mechanism 13 and the spindle nut 18, but not the connection point between the two. The spindle 19 or the spindle nut 18 is rigidly connected to the drive 20 such that the drive 20 can rotate the spindle 19 or the spindle nut 18. The structural unit formed by the drive 20 and the spindle 19 is mounted in the base plate 23 by a ball joint. The base plate 23 has a bearing cup 27, which includes an elbow section having an angle of about 90°. The drive 20 and spindle 19 are mounted using a spherical head 26 and bearing cup 27. The spherical head 26 and the bearing cup 27 can consist of appropriate material, be hardened or have bearing cups or bearing surfaces that have the effect of reducing friction and wear.

A torque on the patient support 11 can lead to errors in alignment of the spindle drive. If a torque is exerted on the double-scissor mechanism 13, for example, as the result of an eccentric load on the patient support 11 being exerted by a patient lying thereon or because of the eccentrically disposed drive 20, a torque is exerted on the patient support 11 and via this onto the spindle drive. This torque can lead to errors in alignment of the spindle drive. The ball joint allows rotation of the spindle drive in such a way that the drive 20 can yield to the torque and compensate for the errors in alignment. The ball joint or the spindle drive can be configured such that the spherical head 26 remains in the ball cup 27 even when the spindle drive is completely disengaged; it is also possible, however, to have a configuration which allows limited lifting of the spindle drive and thus a limited lifting of the spherical head 26 out of the ball cup 27.

In the embodiment shown, the drive 20 is eccentric with respect to the axis of rotation of the spindle 19. The drive 20 is eccentric with respect to the ball joint and thus, as a result of its weight, generates a torque of the spindle drive, this being in fact anti-clockwise in the figure. In order to counteract this torque, the drive 20 is mounted on spring or elastic bearing elements, such as rubber cushions 28. Alternatively, other elastic bearing elements could be used, for example, steel spring elements. The rubber cushions 28 cause the bearing to be moveable by allowing movements of the drive around the ball joint to a slight extent. The rubber cushions 28 have the effect that the drive 20 has self-supporting bearings from the start so that it does not exert any torque on the spindle drive. The rubber cushions 28 are dimensioned such that the drive 20 remains stable in the position shown. The rubber cushions 28 are not arranged symmetrically round the ball joint but eccentrically such that the eccentric part of the bulk of the drive 20 is given greater support.

The moveable bearings for the drive 20 have to be restricted insofar as the drive 20 exerts a rotational force on the spindle 19. The drive 20 has to be protected against rotation despite the fact that the bearings are moveable. This is achieved by a lug 25 which is firmly attached to the drive 20 and engages into an anti-twist device 24. The anti-twist device 24 can rotate around the ball joint as a result of an eccentric load being exerted on the patient support 11 and thus can respond to a change in the alignment of the spindle drive. The anti-twist device 24 can rotate round the ball joint although the drive 20 is prevented from rotating round the spindle 19. The bearings for the drive 20 and the spindle 19 ensure that errors in alignment between the spindle 19 and spindle nut 18 can be compensated for by the eccentric load on the patient support 11.

Figure 4:
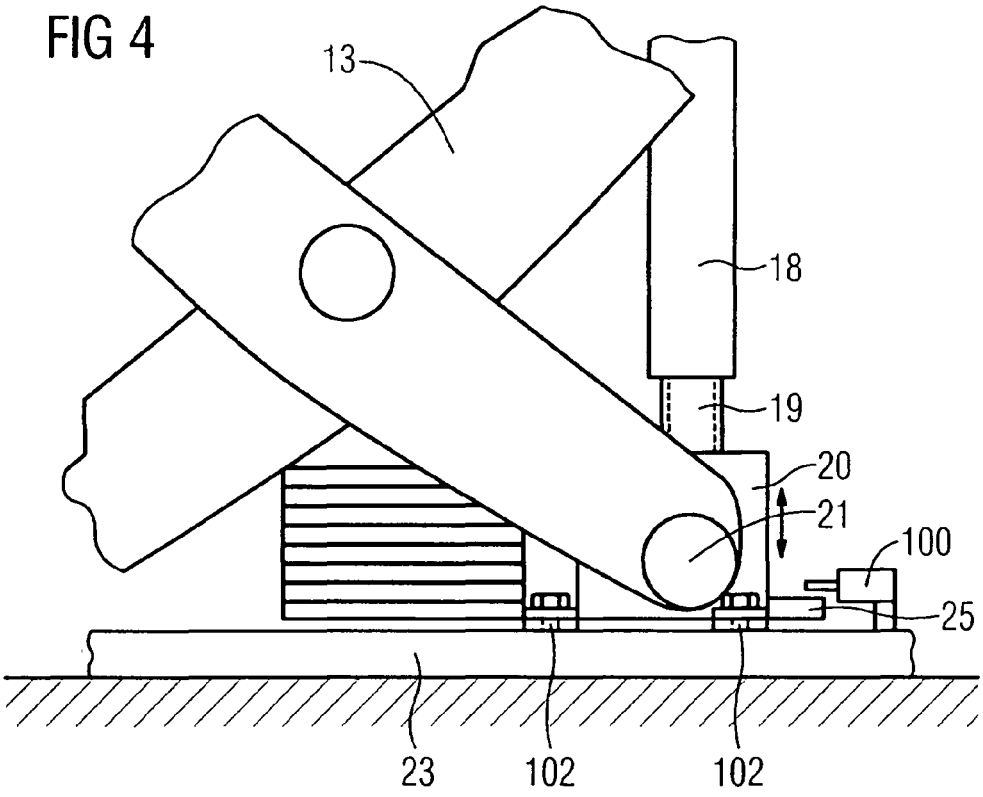
FIG. 4 illustrates a lifting unit with a triggering device in the form of a switch.

FIG. 4 illustrates a lifting unit with a triggering device in the form of a switch. The lifting unit is essentially similar to that described above. Instead of the bearing on rubber cushions 28, a connection to the base plate is provided by position-securing elements 102. These could be configured as threaded rods, for example. The position-securing elements 102 fix the lifting unit in a horizontal direction with respect to the base plate, however, it is moveable to a slight extent in a vertical direction. Vertical mobility is indicated in the FIG. by a vertical two-headed arrow to the right of the lifting unit. Once the freedom of motion of the position-securing elements 102 has been exhausted, the lifting unit is fixed in a vertical direction.

The lifting unit can be shortened or lengthened in a vertical direction in order to raise or lower a patient support 11 or load that is supported thereby. When lowered, the load or patient support 11 may collide with an obstacle that prevents further lowering. The obstacle acts as a brake on the load or patient support 11 while the lifting unit is further shortened by the motorized drive without the above being taken into account. The further shortening of the lifting unit leads to it resting on the base plate with a decreasing weight. Once the weight has become sufficiently low, the lifting unit is raised and lifted off the base plate. The position-securing elements 102, which allow vertical movements of the lifting unit, do nothing to prevent this. In a further embodiment like that described in the aforementioned and in which the lifting unit is mounted on the base plate in a ball joint, the spherical head of the ball joint is lifted out of the ball cup.

As soon as the lifting unit is raised as described above, its lug 25 touches the triggering device configured as a switch. The switch is actuated and thus the triggering device is activated. As a result of the actuation of the switch, the drive 20 of the lifting unit is switched off, so that a further shortening of the lifting unit or a further lowering of the patient support 12 or load is prevented. As a result, a further increasing reduction in the load on the lifting unit is prevented and thus, as a consequence thereof, prevents an increasing load on the position-securing elements 102, which secure the lifting unit in the base plate. A further increase in the load on the obstacle that was collided with, for example, a person or a device, is prevented.

Figure 5:
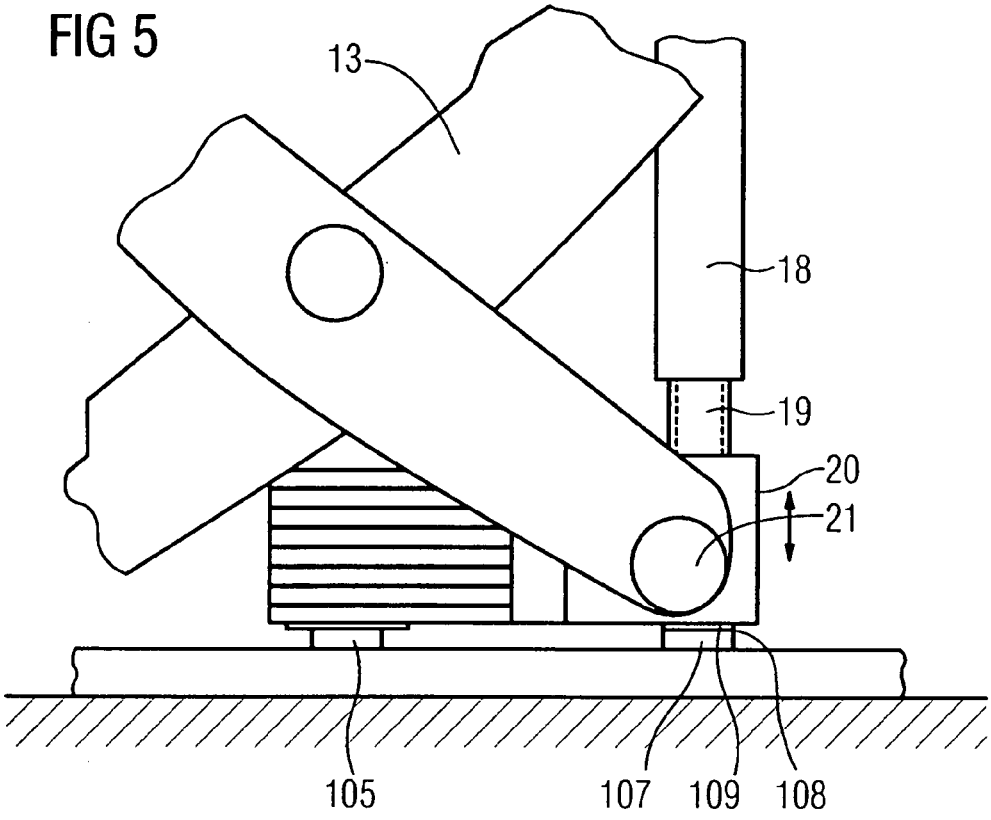
FIG. 5 illustrates a lifting unit with triggering device in the form of an electric contact.

FIG. 5 illustrates a lifting unit with a triggering device in the form of an electric contact. The lifting unit is mounted on bearings 105 in such a way that is vertically moveable at least to a limited extent. The bearings 105 can be configured as rubber cushions 28, as spring elements, or position-securing elements as described above.

An electric contact 108 is provided under the spindle drive between the lifting unit and the base plate 23. The electric contact 108 is created by reciprocal contact between a contact device 107 located on the base plate and of a contact device 109 located on the lifting unit. The contact devices 107, 109 can be configured as metallic contact elements. The contact devices 107, 109 can be configured as integrated bearings and contacts.

When the lifting unit is raised from the base plate, as explained in the above description of FIG. 4, the electric contact is interrupted. This interruption represents the activation of the triggering device and causes the drive of the lifting unit to be turned off.

Figure 6:
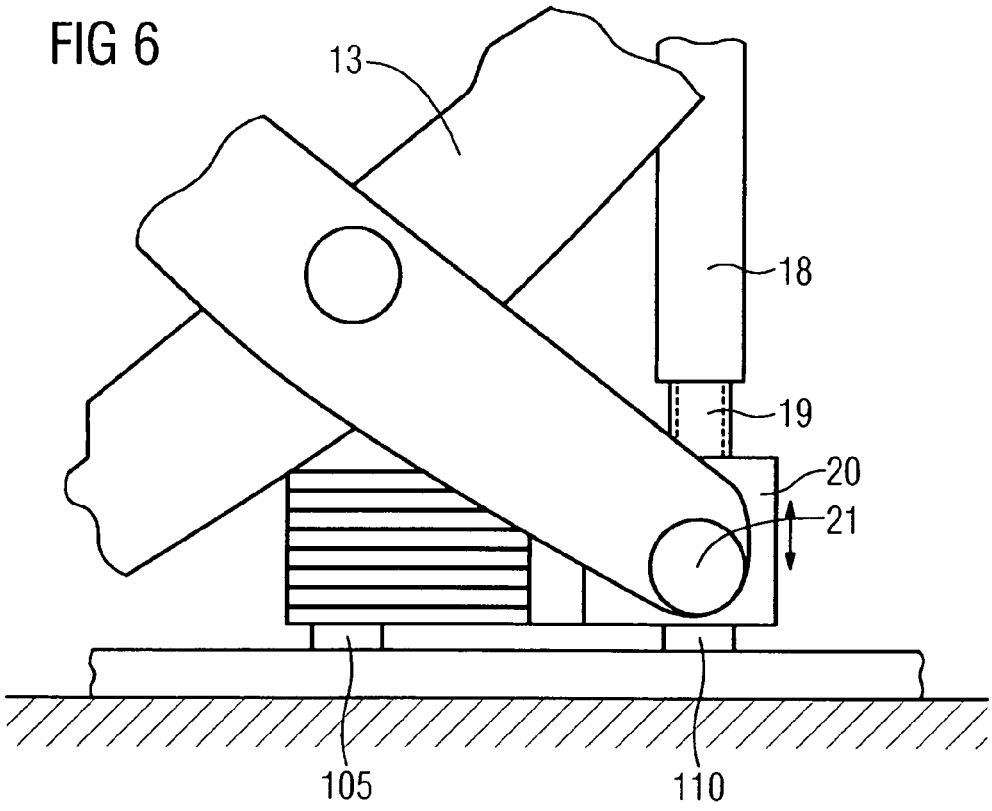
FIG. 6 illustrates a lifting unit with a triggering device in the form of a force or pressure transducer.

FIG. 6 illustrates a lifting unit with a triggering device in the form of a force or pressure transducer. The lifting unit is mounted on bearings 105. A force or pressure transducer 110 is arranged under the spindle drive. The transducer 110 measures the supporting force exerted by the lifting unit on the base plate. If the force measured falls below a predetermined amount, the force or pressure transducer 110 is activated as a triggering device and causes the drive for the lifting unit to be turned off.

Figure 7:
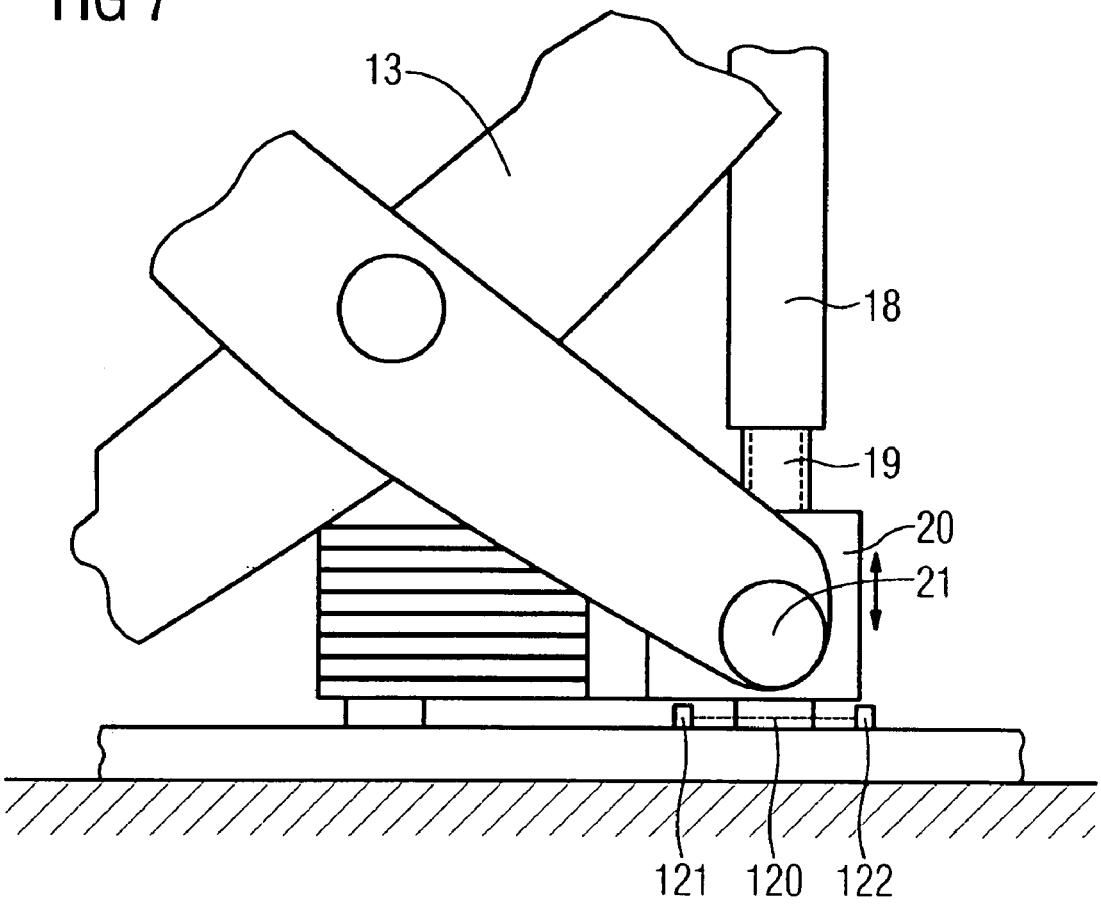
FIG. 7 illustrates a lifting unit with a triggering device in the form of a light barrier.

FIG. 7 illustrates a lifting unit with a triggering device in the form of a light barrier 120. The light barrier 120 includes a light 121 and a light sensor 122. Light generated by the light 121 can reach the light sensor 122 along the path shown in FIG. 7 by a dotted line. As long as the lifting unit is on the base plate, this path is interrupted by an extension 125 of the lifting unit as shown in FIG. 7. If the lifting unit is raised, as described above, then the extension 125 is lifted out of the light barrier 120. As a result, the extension is activated as a triggering device and causes the lifting unit drive to be turned off.

In one embodiment, after the activation of the respective triggering device, the lifting unit can be controlled in such a way that not only is further shortening prevented but that it is additionally lengthened again by a predetermined amount; in other words, not only is the lowering of the load or patient support prevented but the patient support is lifted again by a predetermined amount. As a result, a further increase in the load exerted as the unit is shortened is prevented and the load is immediately reduced again. This in particular is advantageous if there has been a collision with a sensitive device or even a person.

The present embodiments relate to a lifting unit for a patient support device 1. The lifting unit includes a base plate 23, a motorized drive 20, and a lifting drive that can be driven by the drive 20 and which is mounted in the base plate 23. The lifting drive is able to carry out a lifting movement and a movement in the opposite direction. A triggering device is provided. The triggering device is activated when the pressure exerted by the lifting drive on the base plate 23 falls below a pre-determined minimum value. The movement of the lifting drive is stopped in response to the activation of the triggering device. If the patient support device 1 collides with an obstacle as it is lowered, the pressure exerted by the lifting drive on the base plate is reduced. This event is detected by the triggering device and the movement of the patient support device is stopped.

Various embodiments described herein can be used alone or in combination with one another. The forgoing detailed description has described only a few of the many possible implementations of the present invention. For this reason, this detailed description is intended by way of illustration, and not by way of limitation. It is only the following claims, including all equivalents that are intended to define the scope of this invention.

The invention claimed is:

1. A lifting unit for a diagnosis device, a treatment device or a diagnosis and treatment device, the lifting unit comprising:

a base plate, a motorized drive, a lifting drive operable to be driven by the motorized drive and provide a lifting movement in a direction opposite the base plate, the lifting drive being mounted on the base plate, and a triggering device configured as an electric contact that is disposed between the lifting drive and the base plate such that the triggering device is operable to detect when the lifting drive raises up from the base plate, the triggering device being configured to be activated when an electric contact interruption is detected as a result of the lifting drive raising up from the base plate, wherein the movement of the lifting drive is triggered to stop in response to the activation of the triggering device, and wherein the electric contact is created by reciprocal contact between a first contact device located on the base plate and a second contact device located on the lifting device.

2. The lifting unit as claimed in claim 1, wherein the first and second contact devices are configured as metallic contacts.

3. The lifting unit as claimed in claim 1, wherein the movement of the lifting drive is stopped by switching off the motorized drive.

4. The lifting unit as claimed in claim 1, wherein the lifting drive is coupled with a double-scissor mechanism that provides height of a lifting plate connected to a patient support.

5. The lifting unit as claimed in claim 1, wherein the motorized drive is an electric motor, hydraulically-actuated drive, pneumatically-actuated device, or foot-operated device.

6. The lifting unit as claimed in claim 1, comprising a power connection between the motorized drive and the lifting unit, the movement of the lifting drive being stopped when the power connection is interrupted.

7. The lifting unit as claimed in claim 1, wherein the triggering device is a spindle drive.

8. A lifting unit for a diagnosis device, a treatment device or a diagnosis and treatment device, the lifting unit comprising:

a base plate, a motorized drive, a lifting drive operable to be driven by the motorized drive and provide a lifting movement in a direction opposite the base plate, the lifting drive being mounted on the base plate, and a triggering device configured as a light barrier including a light and a light sensor, the light barrier being disposed such that when the lifting unit is on the base plate, a light path from the light to the light sensor is interrupted, and the light path reaches the light sensor when the lifting unit is raised from the base plate, the triggering device being operable to be activated when the light sensor senses the light path from the light, wherein the movement of the lifting drive is triggered to stop in response to the activation of the triggering device.

9. The lifting unit as claimed in claim 8, wherein the movement of the lifting drive is stopped by switching off the motorized drive.

10. The lifting unit as claimed in claim 8, wherein the lifting drive is coupled with a double-scissor mechanism that provides height of a lifting plate connected to a patient support.

11. The lifting unit as claimed in claim 8, wherein the motorized drive is an electric motor, hydraulically-actuated drive, pneumatically-actuated device, or foot-operated device.

12. The lifting unit as claimed in claim 8, comprising a power connection between the motorized drive and the lifting unit, the movement of the lifting drive being stopped when the power connection is interrupted.

13. The lifting unit as claimed in claim 8, wherein the triggering device is a spindle drive.

* * * * *